United States Patent [19]

Warman et al.

[11] 4,034,963

[45] July 12, 1977

[54] MECHANISM FOR MAINTAINING CONSTANT TENSION

[76] Inventors: Charles P. Warman; Jack W. Moss, both of P.O. Box 1150, Wichita Falls, Tex. 76307

[21] Appl. No.: 563,788

[22] Filed: Mar. 31, 1975

Related U.S. Application Data

[63] Continuation of Ser. No. 373,806, June 26, 1973, abandoned, which is a continuation of Ser. No. 687,538, Dec. 4, 1967, abandoned.

[51] Int. Cl.[2] ..... B65D 1/48

[52] U.S. Cl. ..... 254/173 B

[58] Field of Search ..... 254/172, 173 B, 175.7, 254/187 F

[56] References Cited

U.S. PATENT DOCUMENTS

| | | | |
|---|---|---|---|
| 2,303,847 | 12/1942 | Lamond | 254/172 |
| 2,823,896 | 2/1958 | Hood | 254/168 |
| 2,956,650 | 10/1960 | Wilson | 254/172 X |
| 2,966,221 | 12/1960 | Kinney | 254/172 X |
| 3,373,972 | 3/1968 | Peterson | 254/187 |

*Primary Examiner*—Allen N. Knowles
*Assistant Examiner*—Hadd Lane

[57] ABSTRACT

A constant tension winching mechanism which has a friction clutch interposed between the drive member and the drum of the winching mechanism. A conduit system is connected to the clutch for directing a cooling media thereinto and therefrom so the clutch will not be damaged by the heat generated by continuous slippage. A variable controller is provided to control the degree of engagement between the friction elements within the clutch, which controller may be either manually or automatically operated. The cable which leads from the winding drum is provided with a cable tension sensing mechanism which will operate the variable controller to maintain a constant tension on the cable at all times when operated by an automatic control. An actuator line is shown which leads to the clutch to vary the engagement of the friction elements within the clutch.

3 Claims, 10 Drawing Figures

MECHANISM FOR MAINTAINING CONSTANT TENSION

This application is a continuation of application Ser. No. 373,806, filed June 26, 1973, now abandoned; which is a continuation of application Ser. No. 687,538, filed Dec. 4, 1967, now abandoned.

This invention relates to improvements in winching mechanisms and more particularly to winching mechanisms which exert a constant tension on a winch line over an indefinite period of time, or continuously, if desired. The tension on which winch line may be preset or may be varied selectively, by the individual who operates the controls of the winching mechanism.

Various winching mechanisms have been proposed heretofore, but these, for the most part, did not maintain a constant tension on a cable over a long period of time or continuously, therefore, had to be manually controlled, which was objectionable, as it required an individual of great skill to operate the controls of the winching mechanism to keep the winch line at approximately uniform constant tension.

Certain attempts have been made to provide for controlling the tension of a winch line, within limits, as set forth in U.S. Pat. No. 2,422,274 to John Hart Wilson, Winch, dated June 17, 1947, however, due to the fact that the clutch was not water cooled, the clutch could not be expected to operate over a long period of time, without becoming overheated, if used to the fullest extent. U.S. Pat. No. 3,158,355, Nov. 24, 1964 to John Hart Wilson, Multi-Drum Winch, likewise maintained a constant tension on a cable, however, the clutch thereof could not be expected to operate continuously, at full maximum rating, without the clutch becoming overheated, while being slipped. It is, however, pointed out in this patent, column 6, lines 21–22, that "By pulling each cable in this manner after each clutch on the respective drum shafts slips, a uniform tension will be imparted to the cable." However, the clutches so used, being air cooled, limited the load which could be pulled under constant tension over an extended period of time, without the clutches becoming overheated.

Various water cooled brakes and clutches have been proposed heretofore, such as U.S. Pat. No. 3,000,470 to Joseph M. Milan, Water Cooled Disc Type Brake Assembly, dated Sept. 1961. Charles P. Warman application for patent Ser. No. 556,793, Heat Dissipating Clutch or Brake With a Peripherally Pivoted Planar Wear Plate for Expansive Movement in a Coextensive Plane, filed May 6, 1966 and now U.S. Pat. No. 3,435,936, issued Apr. 1, 1969, Heat Dissipating Clutch. The patent to R. G. Friedman, U.S. Pat. No. 2,778,451, A Disc Brake, issued Jan. 22, 1957, shows a coolant liquid circulated in close relation with the brake elements.

The present winching mechanism is so designed that a predetermined tension thereon may be manually controlled so as to permit a water cooled clutch therein to slip continuously to maintain a winching line properly tensioned, or an automatically operated sensing device may be associated with the winch line, such as disclosed in the patent to Art I. Robinson, U.S. Pat. No. 3,289,967, Tension Regulator, dated Dec. 6, 1966, which device, if associated with the constantly slipping clutch, will regulate the air thereto to permit the water cooled pneumatic clutch, under constantly controlled air supply to the clutch, to operate a winching drum to maintain a constant tension on the cable in accordance with the setting of the automatic tension regulator.

In performing certain operations with a winch line, it is desirable, as the line becomes less taut, that the prime mover, connected to the winch by the clutch, will wind the line onto the drum of the winch and maintain the winch line at a constant tension, or if the force is greater than the predetermined setting of the automatic tension regulator, the cable will be allowed to unwind from the drum of the winch at a constant tension.

While there are many applications for a winch of this character, a few applications will be particularly pointed out; in the lowering or lifting of cargo from a floating vessel, such as a barge or the like, it is desirable to present a constant tension on the winch cable, due to the motion of the waves which cause a rise and fall of a vessel with respect to the rise and fall of the barge or the like from which cargo is being unloaded or the unloading of cargo from a vessel onto a dock, wherein the vessel will rise and fall in accordance with the waves on the body of water.

The present invention also enables a constant tension to be maintained on a winch line or cable, as in the towing of a vessel or maintaining a "breeches buoy" line, or a tramway line between two vessels for interchange of cargo or the like at sea.

The present device may also be used in construction of power lines which requires the pulling of long lengths of power line cable, at a fixed tension, which pull may be exerted over a long period of time by slipping the clutch, without undue harm to the clutch, by dissipation of heat to the water cooled element.

An object of this invention is to provide a winching device whereby a clutch may be slipped continuously to maintain a constant tension on winch line.

Another object of the invention is to provide a winching mechanism for exerting constant tension on a winch line which may be manually controlled by the individual operating the controls of the winching device.

Still another object of the invention is to provide a winching mechanism with a water cooled clutch associated therewith, which winching mechanism may be operated continuously without overheating the clutch elements, while maintaining a constant tension on a winching line.

Yet another object of the invention is to provide a winching mechanism which may be readily shifted from automatic tension regulation to manual tension regulation to enable the winch to be put to a variety of uses.

A still further object of the invention is to provide a constant tension winching device with a fluid cooling system associated therewith, which device will enable continuous slipping of the clutch without the clutch becoming overheated.

With these objects in mind and others which will become manifest as the description proceeds, reference is to be had to the accompanying drawings in which like reference characters designate like parts on the several views thereof, in which FIG. 1 is a perspective view of a winching mechanism, showing a prime mover associated therewith, an air supply line associated therewith, and a water line shown as leading into the winching mechanism, with a discharge line leading therefrom, showing a level wind spooling mechanism associated therewith and a winch line or cable extending outwardly therefrom, with an automatic cable tension regulator sensing device associated with the winch line and winch controls and cable tension controls associated with the winching mechanism;

Figure 4:
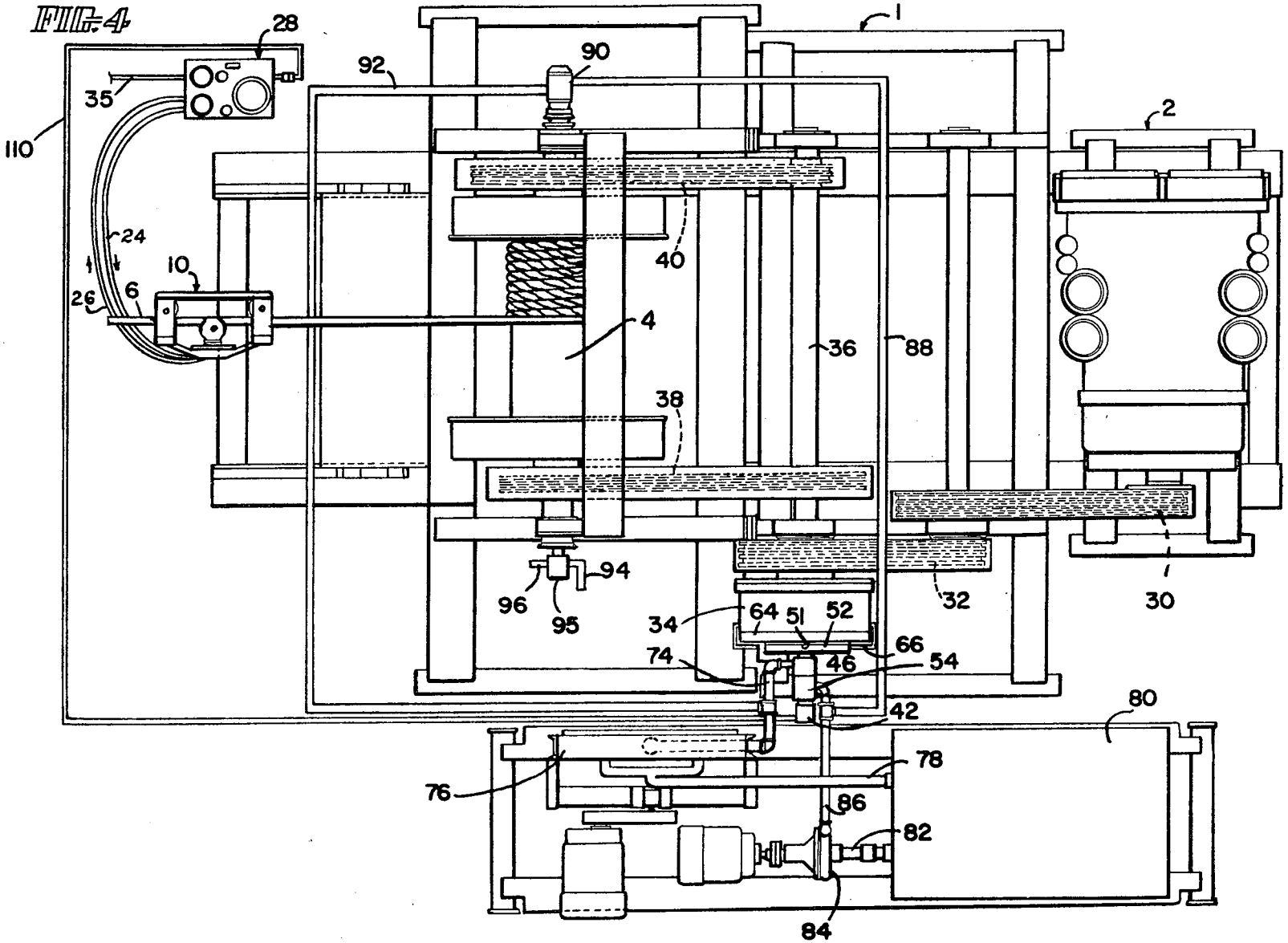
Figure 5:
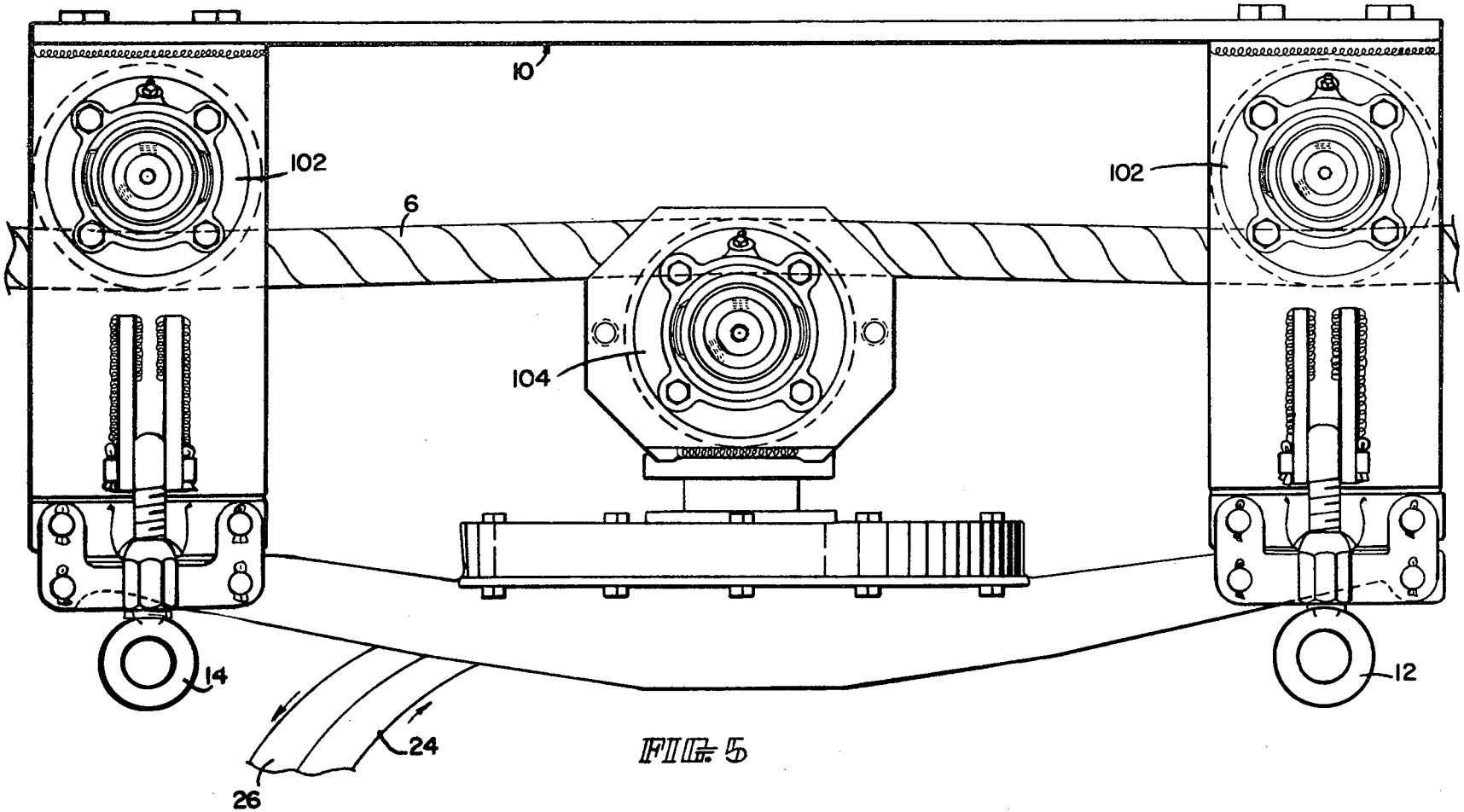
Figure 6:
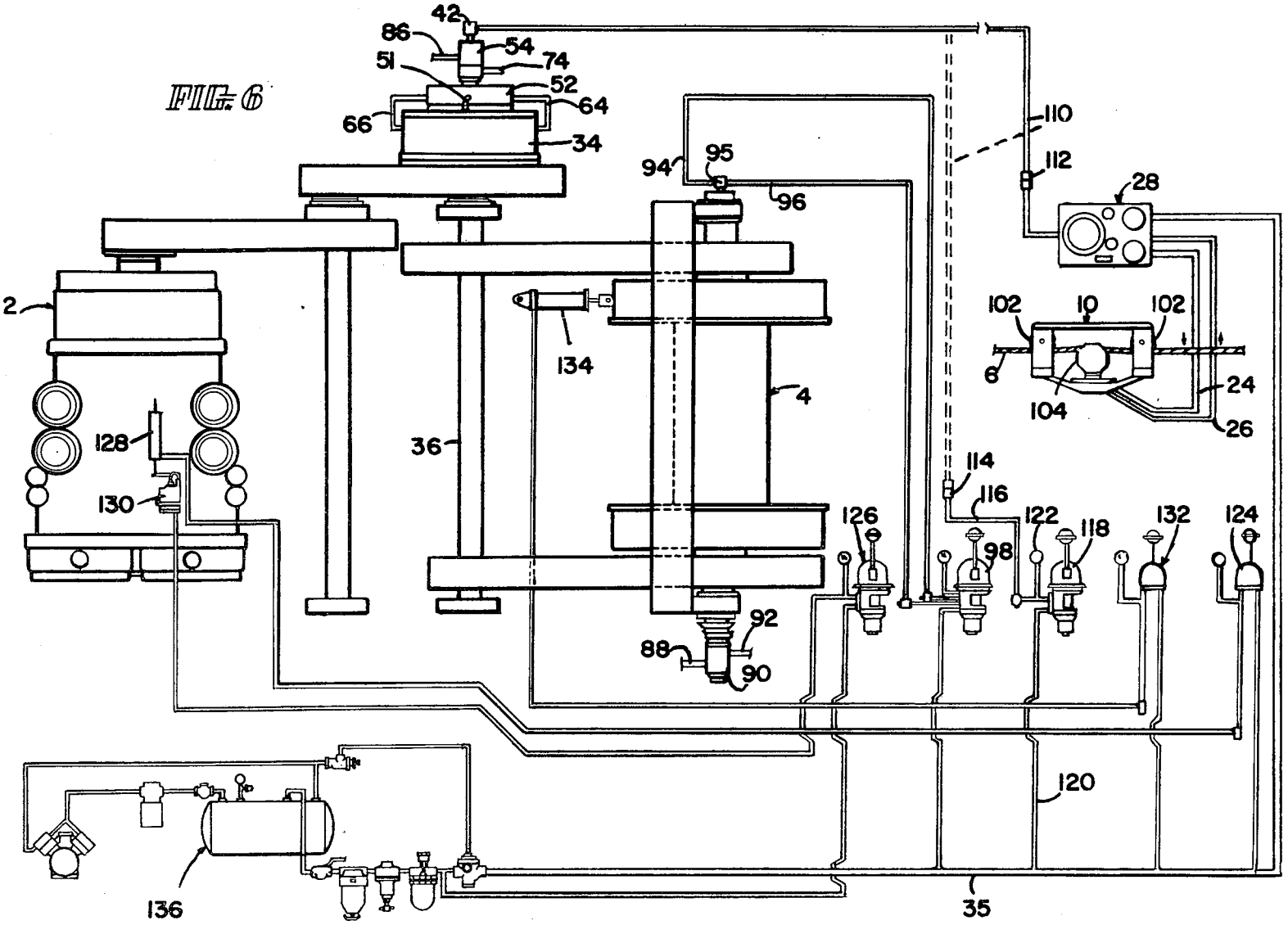
Figure 7:
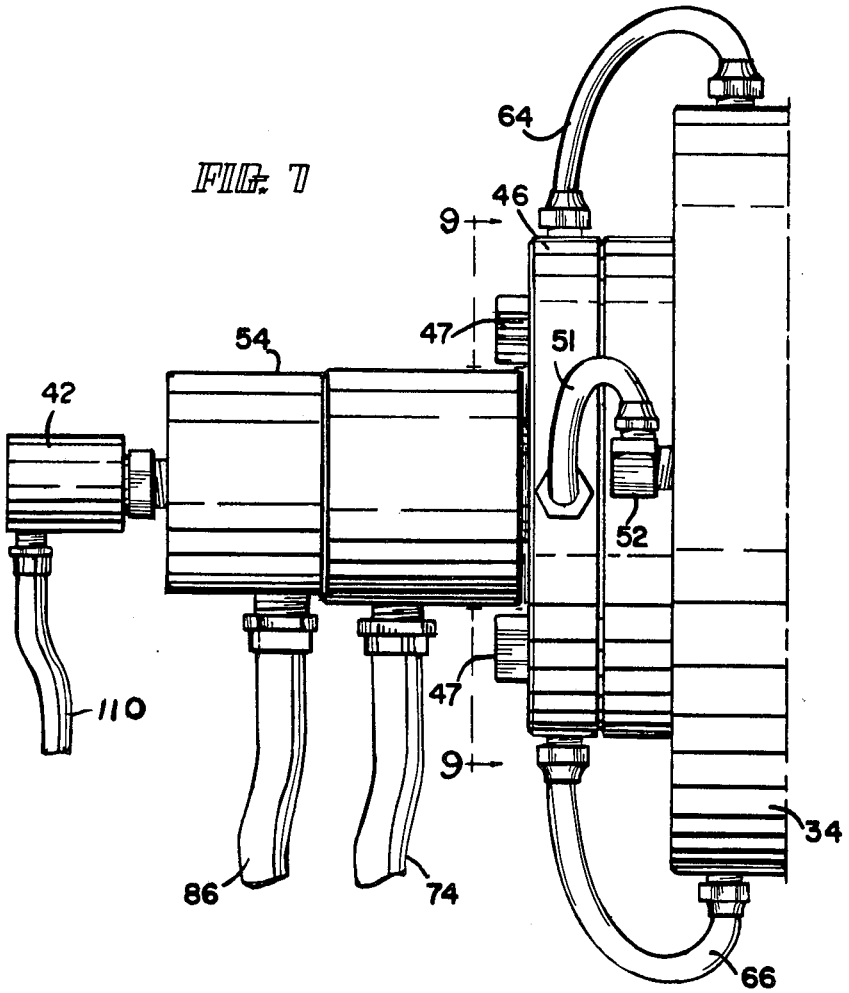
Figure 9:
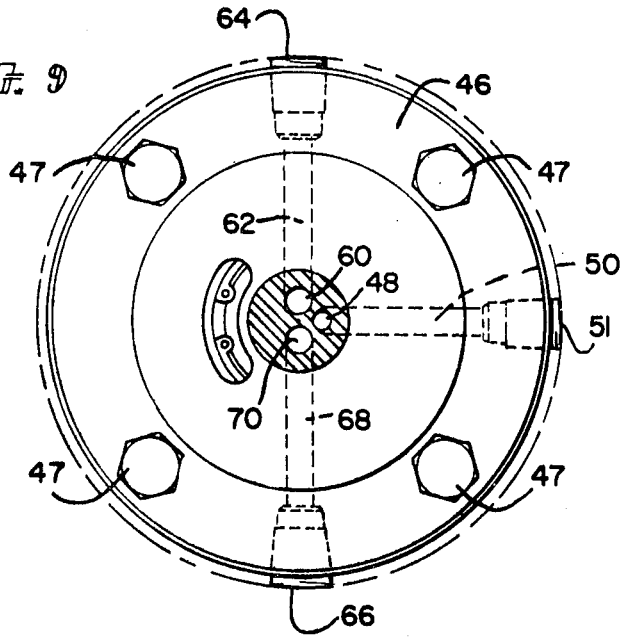
Figure 8:
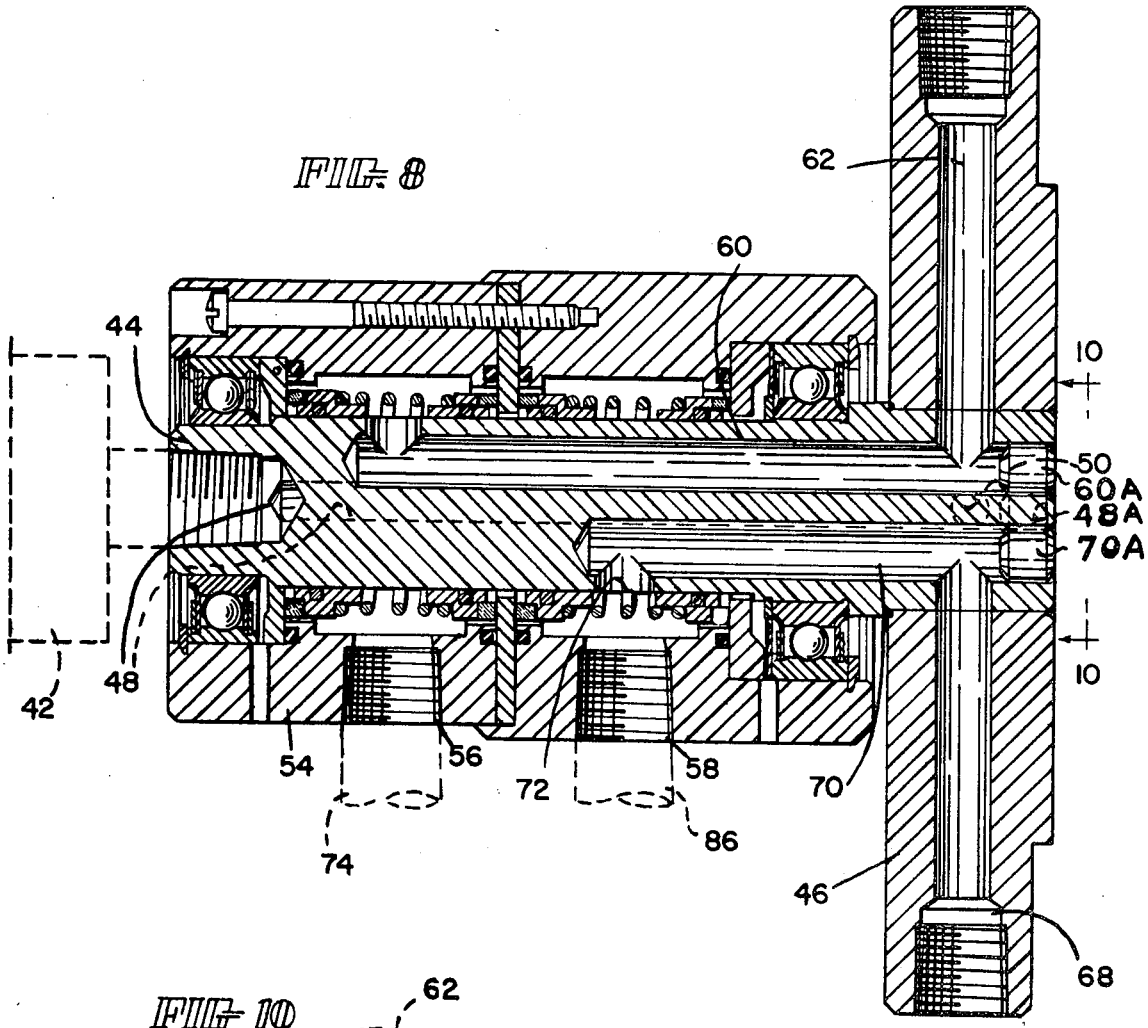
Figure 10:
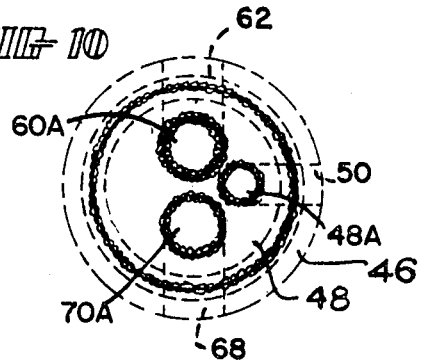

FIG. 4 is a top plan view of the winching mechanism with the housing and the level wind mechanism removed therefrom, showing the cooling fluid conduits associated with the clutch, and showing a fluid supply system, including a reservoir, radiator and pumping system to circulate a fluid, such as water or gas, into and out of the fluid cooling clutch, and to the brake drum of a winch, and showing a line for supplying a fluid, such as air, to an automatic cable tension sensing control and showing fluid lines leading from the sensing control to the automatic cable tension regulator;

FIG. 5 is an enlarged side elevational view of the automatic cable tension sensing device, showing a fragmentary portion of cable therein, which cable is angulated for passing between the sheaves on the cable tension sensing device, and showing fluid hose leading therefrom to the sensing control unit;

FIG. 6 is a diagrammatic view of the winching mechanism, showing diagrammatically the fluid system, such as air, connected to the various control elements, and to the clutch and brakes of the winching mechanism, with a fragmentary portion of cable, with the automatic cable tension sensing device thereon, and showing the device in fluid communication with the automatic cable tension regulator, with portions being broken away and with portions shortened in order to show the details of invention, and with alternate positions of parts being shown in dashed outline;

FIG. 7 is an enlarged, fragmentary elevational view showing the rotatable seals and the distributor ring connected to the air actuated clutch;

FIG. 8 is a longitudinal sectional view through the distributor ring and the rotating seal elements;

FIG. 9 is a sectional view taken on the line 9—9 of FIG. 7, looking in the direction indicated by the arrows; and FIG. 10 is a sectional view taken on the line 10—10 of FIG. 8, looking in the direction indicated by the arrows.

Figure 1:
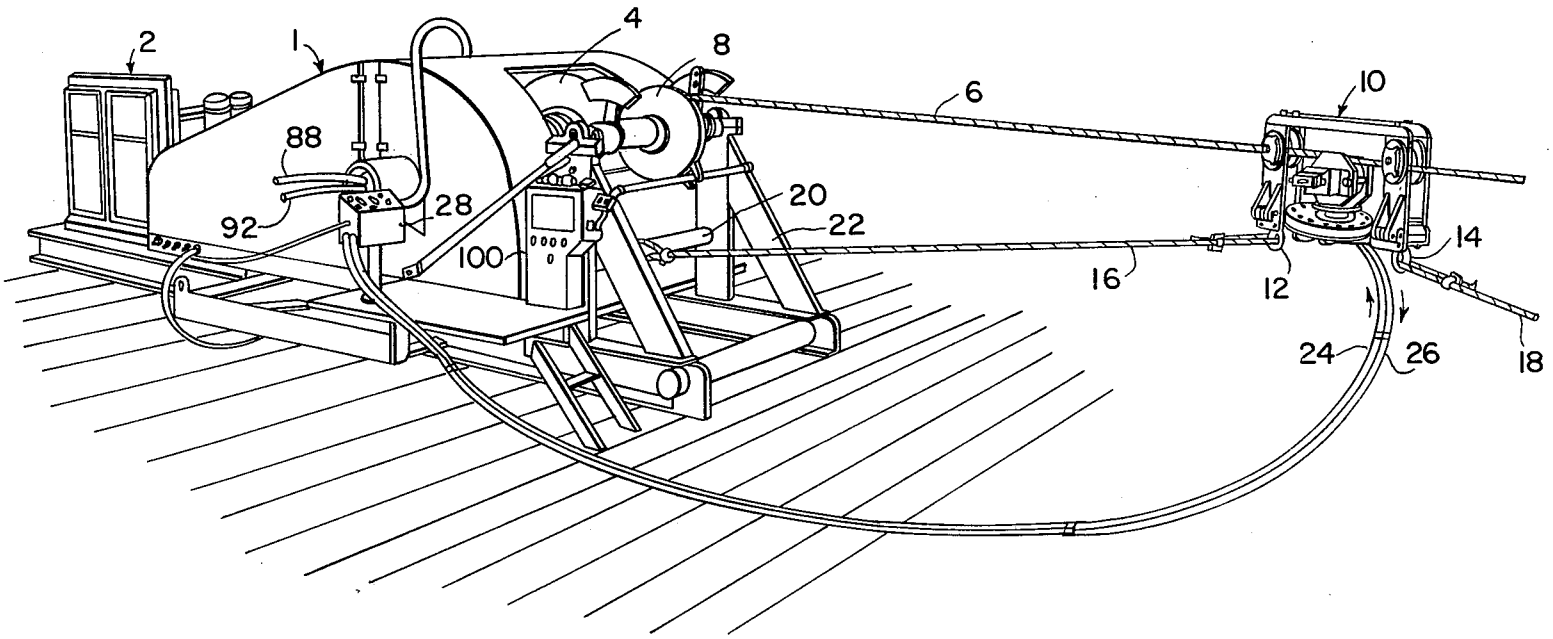
Figure 2:
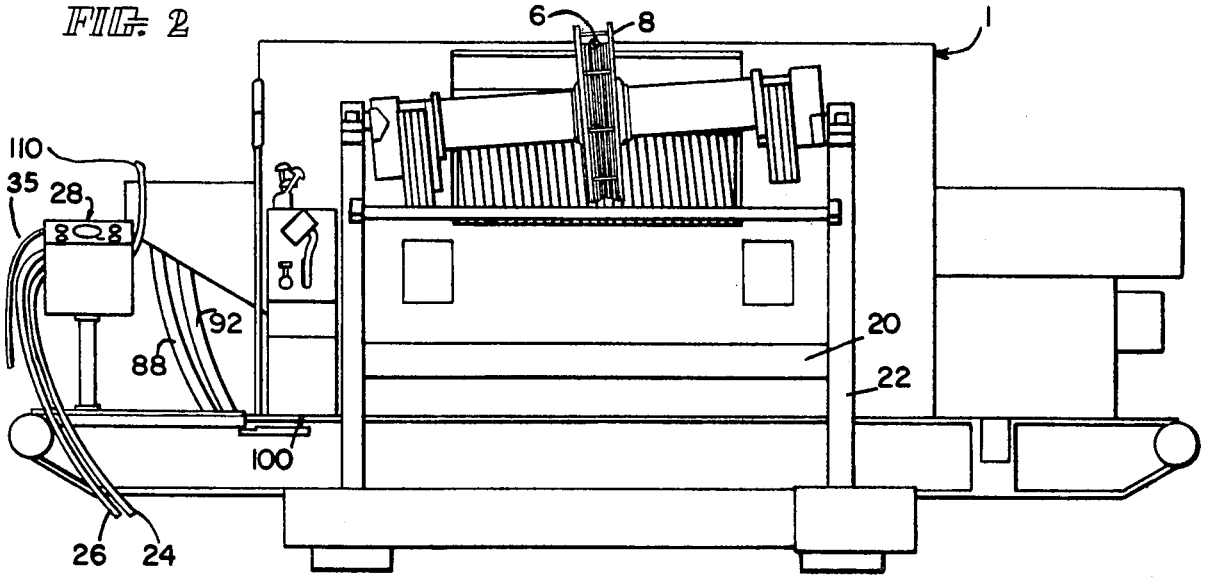
FIG. 2 is a front elevational view of the assembled winching mechanism, showing a level wind spooling mechanism associated therewith, a winch control device and an automatic cable tension regulator associated therewith.

With more specific reference to the drawings, the numeral 1 designates generally a winching mechanism which is connected to a prime mover, designated generally by the numeral 2, in driving relation, as will be more fully brought out hereinafter. The winching mechanism 1 has a drum 4 therein on which is wound a cable 6 which cable, in the present instance, passes over a level winding mechanism 8 and outward therefrom, as indicated in FIG. 1.

A cable tension sensing control device, designated generally by the numeral 10, is supported on the cable 6, to indicate the tension on the cable at all times, as the cable 6 passes therethrough. The cable tension sensing control device 10 has anchor eyes 12 and 14 thereon, to which the respective anchor cables 16 and 18 are attached. The cable 16 extends to a member 20 on the structural frame 22 of winching mechanism 1 and is anchored thereto. The cable 18 extends outward from the cable tension sensing control device and is anchored to a stationary anchor (not shown). The cable tension sensing device 10 has fluid lines 24 and 26 leading therefrom, to a tension regulator control unit designated generally by the numeral 28 which unit is more clearly shown in the U.S. Pat. No. 3,289,967, to Art I. Robinson as recited above.

Figure 3:
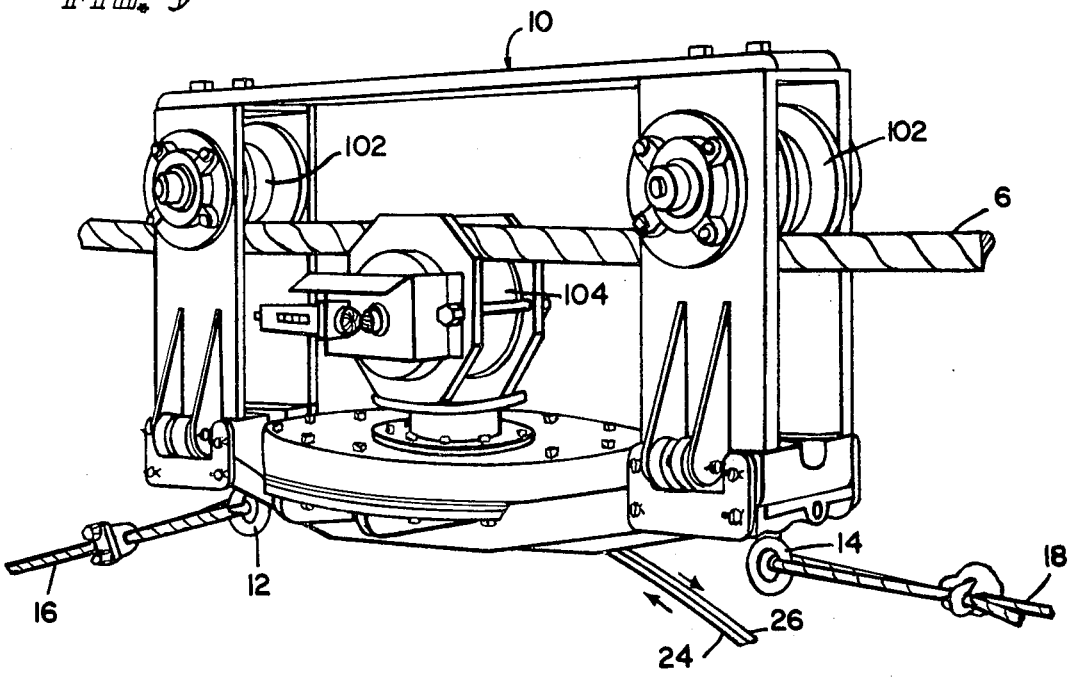
FIG. 3 is a perspective view of the automatic cable tension sensing device, showing a fragmentary portion of cable passing therethrough and showing anchor lines attached thereto to stabilize the cable tension sensing device against longitudinal movement with respect to the cable, and showing air hose leading therefrom to the automatic cable tension regulator.

The cable tension sensing device 10 is shown in elevation in FIG. 5, and the opposite side and an end thereof is shown in the perspective view, FIG. 3. The cable tension sensing device is positioned on a cable 6 so as to sense the tension thereof, whether the cable is a moving line or a dead line, so as to enable the proper tension to be maintained on the cable 6 at all times, by the winching mechanism 1.

The winching mechanism 1 is driven by the prime mover 2 through a series of endless transmission driving means 30,32 to drive a clutch mechanism 34. The clutch may be selectively coupled, in driving relation, with the countershaft 36 with which countershaft high and low speed endless transmission driving means 38 and 40 are associated to connect the countershaft in driving relation with the winch drum 4, on which cable 6 is wound.

The clutch 34 is a water cooled clutch which may be slipped continuously to maintain a torque on countershaft 36, which in turn, through transmission driving means 38 and 40, such as an endless transmission chain, will exert a torque on drum 4, which in turn, will exert a predetermined constant tension on cable 6, when used with cable tension sensing control device 10, in a manner to be more fully brought out hereinafter. The water cooled clutch 34 embodies the construction as shown in copending application of Charles P. Warman, Ser. No. 556,793, now U.S. Pat. No. 3,435,936 above mentioned, which construction permits cooling fluid, such as water, gas, or the like to be circulated therethrough to dissipate the heat generated and to maintain the friction members of the clutch at a temperature below that at which the clutch friction members and clutch plates will be damaged by heat.

The clutch 34 is air actuated and is connected to an air supply conduit 110 through a conventional rotary air seal 42 which air seal is mounted axially on an axial member 44, which rotates with distributor ring 46 so that air may be passed from the rotary air seal 42 into and through a passage 48 in axial member 44, thence into a passage 50 in distributor ring 46, with an air hose 51 being connected thereto and to a pipe fitting 52, which fitting connects with an axially expansible air chamber (not shown) within clutch 34 such as disclosed in the patent of Charles P. Warman, U.S. Pat. No. 3,435,936, above mentioned. The distributor ring 46 is secured to the shell or housing portion of the clutch 34 by bolts 47, as will best be seen in FIG. 7.

A stationary portion of rotary fluid seal 54 is mounted on the axial member 44 in journaled relation and has an inlet fluid passage 56 thereinto and an outlet fluid passage 58 leading therefrom. The stationary portion of rotary fluid seal 54 is sealed against leakage of fluid to the exterior thereof and against leakage of fluid between the inlet and outlet passages. The inlet passage 56 connects with a longitudinal passage 60 within axial member 44, which longitudinal passage connects with an outlet passage 62 to which a hose 64 is connected. The outlet end of hose 64 is connected with a passage within the clutch, as embodied in the above application Ser. No. 556,793, with the fluid exhausting from the passages in the clutch into hose 66 connected thereto, and to a passage 68 in distributor ring 46.

Whereupon, cooling fluid is exhausted into longitudinal passage 70 in rotating member 44, thence outward through lateral passage 72 into the stationary portion of the rotary seal 54, thence out through passage 58 into fluid discharge line 74 into and through radiator 76 to cool the cooling fluid, thence through conduit 78 into storage reservoir 80. Whereupon, the fluid is withdrawn from reservoir 80 through conduit 82 into pump 84 and through conduit 86 into the stationary portion of rotary seal 54 to complete the cooling cycle.

A branch conduit 88 connects with conduit 86 and leads to the stationary portion of a rotary fluid seal 90 to direct water into and through the brake rings of drum 4, in a manner as disclosed in patent No. 2,944,790, to John Hart Wilson. The water is directed outward from the stationary portion of the fluid seal 90 into conduit 92, which connects with conduit 74, to be directed through the radiator 76 in the manner hereinbefore set out.

The drum 4 has conventional air actuated clutches associated therewith to enable the engagement of endless transmission members 38 or 40 or vice versa, by selectively directing air either into conduit 94 through rotary air seal 95 to operate one of the clutches on the drum 4 or into conduit 96 through rotary air seal 95, so the air may be directed under pressure to the other of the drum clutches by operating clutch control valve 98 on control panel 100, or the valve 98 may be moved into a position so both clutches are disengaged, in a manner well understood in the art of hoisting mechanisms, such as set out in U.S. Pat. No. 2,944,790, to John Hart Wilson, or both drives 38 and 40 may be disengaged.

The cable tension sensing device 10 has two sheaves 102 and one sheave 104 thereon, which sheaves are so arranged as to create an angle to the cable, as the cable 6 passes over and between these sheaves, which will actuate a mechanism (not shown) in the cable tension sensing device 10 which will enable air to be directed through conduit 24 from cable sensing regulator control unit 28 through cable tension sensing device 10 and out through conduit 26 to cable sensing regulator control unit 28. This will actuate a mechanism therein to cause air to be passed from air supply line 35 through cable tension regulator control unit 28 and directed into air line 110 which leads to the stationary portion of rotatable seal 42, thereby air is directed at a regulated controlled pressure, into clutch 34, or is released therefrom so as to maintain the axially expansible air tube (not shown) in clutch 34 properly inflated in order to create the exact required friction between the friction elements within clutch 34 to rotate countershaft 36 at a torque so as to transmit power through endless transmission drive means 38 or 40 to drum 4 so as to maintain a predetermined constant tension on cable 6 in accordance with a predetermined setting of tension regulator control unit 28. In this manner a constant tension may be automatically maintained on cable 6.

An alternate method of controlling the tension on cable 6 may be had by detaching connection 112 in air line 110 and connecting the air line 110 to a connector 114 on an air line 116, which air line 116 connects with a manual, variable control valve 118, whereby air is directed from air supply line 35 through air line 120 and thence through variable control valve 118 into air line 116 on which an air pressure gauge 122 is connected. An operator may visually watch air pressure gauge 122, and, by making use of acquired knowledge, of chart, operates a variable pressure valve to control the amount of tension which will be applied to cable 6 by air clutch 34. With the drum clutch shifted into the particular speed or gear desired, the line may be manually controlled at a predetermined tension, within limits. An operator must continuously monitor the tension of the cable and adjust the variable pressure valve 98, when necessary, to control the air pressure to the clutch 34 if constant tension on cable 6 is to be maintained.

FIG. 6 shows primarily the air conduit system, diagrammatically, as associated with the winching mechanism with an air valve 124 within an air conduit which leads to an air cylinder 128 which actuates a mechanism to cut off the fuel supply to the prime mover 1. An air control valve 126 leads to the throttle mechanism 130 of the prime mover to vary the speed of the prime mover, when not on automatic control.

A variable air pressure control valve 132 is connected to air supply line 35 and to an air cylinder 134 by conduits, to control the brake bands (not shown) of the drum 4. A source of air supply is designated generally at 136 and includes the necessary compressor, air storage tank, pressure regulators and the like, with the air supply line 35 leading therefrom.

Having thus clearly shown and described the invention, what is claimed as new and desired to be secured by Letters Patent is:

1. A winch system comprising in combination;

a. a prime mover, b. a winch drum having a cable wound thereon in winching relation, c. tension sensing means engaging said cable for producing an output signal related to the tension in said cable, and d. drive means connecting said prime mover to said drum for controlling the tension on said cable, said drive means including an intermediate shaft in driven relation between said prime mover and said winch drum, a water cooled clutch capable of continuous slip connecting said prime mover to said intermediate shaft, low speed tension means connecting said intermediate shaft to said winch drum and including a selectively operable clutch for driving said winch drum at low speed relative to said intermediate shaft, high speed transmission means connecting said intermediate shaft to said clutch and including a selectively operable clutch for driving said winch drum at high speed relative to said intermediate shaft, control means for selectively connecting said low and high speed transmission means to said winch drum, and control means connected to the output signal of said tension sensing means and to said water cooled clutch for maintaining a constant tension on said cable irrespective of the relative speed of said intermediate shaft as effected by selection of said low and high speed transmission means.

2. A winch system as defined in claim 1; wherein a. said water cooled clutch is an air actuated clutch, b. said clutch is associated with said winch drum to selectively engage the air actuated, water cooled clutch with the winch drum to maintain a constant tension on said cable.

3. A constant tension, variable slip winching mechanism for use with a prime mover, which mechanism comprises;

a. a winch frame, b. a shaft mounted on said winch frame, c. a winch drum mounted on said shaft for rotation about the axis thereof, 1. a cable connected to said winch drum and being wound thereon in winching relation, d. drive means connected in driving relation with said drum, said drive means including reduction gearing connected in direct driving relation to said drum.

e. a continuous slip clutch interposed, in driving relation, in said drive means to said drum, 1. said clutch including a conduit system for circulating a cooling medium therethrough and therefrom to continuously cool engaging parts within said clutch to permit the clutch to slip continuously, without being damaged by heat generated therein, to maintain the cable wound on said drum at a constant tension, f. operator means for varying the rate of slippage of said clutch, 1. said operator means being a diaphragm fluid actuated sensing means to sense the tension of a movable cable of the winching mechanism to automatically control the degree of clutch slip to maintain the tension on the cable constant, whether static or moving in either direction.

* * * * *